US005450642A

United States Patent [19]

Dusek

[11] Patent Number: 5,450,642

[45] Date of Patent: Sep. 19, 1995

[54] METHOD OF ASCERTAINING RELAXATION AND SHRINKAGE BEHAVIOR OF TEXTILE FABRICS AND TEXTILE PRODUCTS AND THE EQUIPMENT FOR CARRYING OUT THIS PROCESS

[75] Inventor: Zdenek Dusek, Partille, Sweden

[73] Assignee: Institutet for Fiber- Och Polymerteknologi, Gothenburg, Sweden

[21] Appl. No.: 211,839

[22] Filed: Apr. 28, 1994

[30] Foreign Application Priority Data

Jun. 12, 1992 [CS] Czechoslovakia ..... 1796-92

[51] Int. Cl.[6] ..... D06B 5/24

[52] U.S. Cl. ..... 8/159; 68/15; 68/133

[58] Field of Search ..... 68/15, 132, 133, 134; 8/158, 159; 73/159; 34/60

[56] References Cited

U.S. PATENT DOCUMENTS

| | | | |
|---|---|---|---|
| 767,568 | 8/1904 | Kellum | 68/154 |
| 2,151,354 | 3/1939 | Osuch | 68/133 |
| 2,869,346 | 1/1959 | Brucken . | |
| 3,015,226 | 1/1962 | Darby et al. | 68/15 |
| 3,091,955 | 6/1963 | Taylor et al. . | |
| 3,597,851 | 8/1971 | Arendt et al. . | |
| 4,164,116 | 8/1977 | Kimura et al. . | |
| 4,268,941 | 5/1981 | Fleissner . | |
| 4,691,538 | 9/1987 | Shikamori et al. . | |

FOREIGN PATENT DOCUMENTS 0381765 12/1989 European Pat. Off. .

OTHER PUBLICATIONS

"Preduction of Finished Weight and Shrinkage of Cotton Knits—The Starfish Project", *Textile Research Journal*, by S. Allan Heap et al., Feb. 1983, pp. 109–119, of Manchester, England.

"Preduction of Finished Relaxed Dimensions of Cotton Knits—The Starfish Project", *Textile Research Journal*, by S. Allan Heap et al., Apr. 1985, pp. 211–222 of Manchester, England.

*Primary Examiner*—Frankie L. Stinson

*Attorney, Agent, or Firm*—Young & Thompson

[57] ABSTRACT

A method of ascertaining relaxation and shrinkage behavior of textile fabrics and textile products where a sample is separately submitted to a short complete washing cycle in a whirling hot washing bath and to a few short complete treatment cycles in a whirling hot water bath, each cycle being finished by a short hydroextraction of the sample and drying in a hot air stream, the method being performed during incessant movement of the yarns at cross-over points and flexing of the yarns in the textile structure of the sample. An apparatus for performing the method of the invention which comprises a vertical perforated drum (1) containing at least (2) radially arranged partitions dividing the drum into two or more chambers and rotatable in two directions, arranged in a heat insulated protecting casing (7), covered by a lid (8), a means which can give the drum alternately a rotational motion or an oscillating motion, an air heater (11) connected over inlets (12) to the inside of the casing (7), above each chamber, and a water heater (15) connected to the casing via a water inlet and outlet pipe (18).

19 Claims, 3 Drawing Sheets

Figure 1:
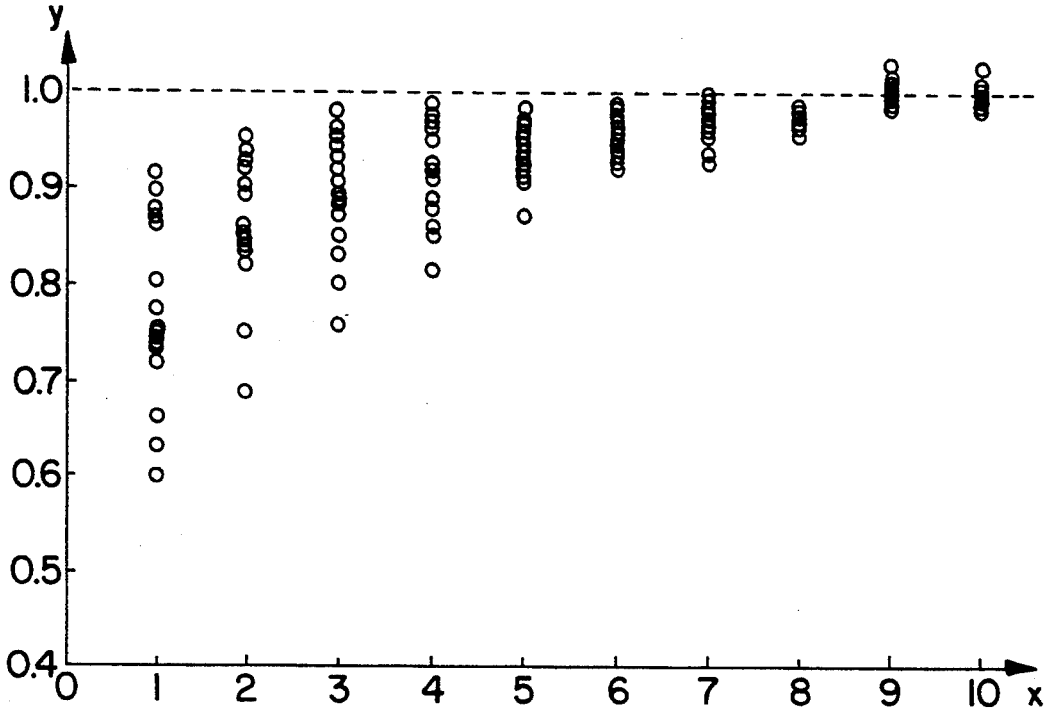

METHOD OF ASCERTAINING RELAXATION AND SHRINKAGE BEHAVIOR OF TEXTILE FABRICS AND TEXTILE PRODUCTS AND THE EQUIPMENT FOR CARRYING OUT THIS PROCESS

TECHNICAL FIELD

The invention concerns a method for ensuring rapid relaxation and shrinkage of textile fabrics and textile products particularly of woven and knitted ones, as well as an equipment for carrying out this method. This method is also suitable for ascertaining textile fabrics' and textile products' tendencies to spiraling and twisting and changes in appearence as pilling etc. The method of obtaining rapid relaxation and shrinkage of textile fabrics and textile products is based upon the principle of quick repeated washing, rinsing, hot water treatment and drying of a textile fabric reference sample. The object of the invention is primarily the determination of parameters for carrying out the finishing treatment of the textile fabric and checking of the shrinking potential at any step when processing or using textiles.

THE ART

It is generally known that both woven and knitted fabrics have, after the final processing of the same, a certain, in many cases a very considerable, shrinking potential. This becomes apparent in not set goods as a gradual shrinkage of the textile fabric when both relaxation of the tension of the textile fabric structure and the shrinkage of threads occur. This problem is rather important with knitted fabrics where without finding out the final shrunk state of the knitted fabric, the so called fully relaxed state, the properties of the same knitted fabrics can not be characterized since these otherwise may be different and depend on the relaxation state of the knitted fabric. The importance of finding this state of total relaxation, has been established in a great number of studies which have been very well summarized in the research study G. Bühler and H. Haid "Dimensionsstabilität von Maschenwaren—aus der Sicht yon Forschung und Entwicklung", Wirkerei und Strickerei—Technik 34, 12, 1984, 1201–1204, and 35, 1, 1985, 42–49 (1). This study is very complete and has 138 references. For determining the knitted fabric reference state there are recommended different methods of washing and drying the textile sample by using household washing machines at present. Based upon the extensive experimental work of the IIC institute, it has been recommended for achieving the relaxation state of the knitted fabric, i.e. its reference state, to carry out at least one complete washing cycle and four rinsing cycles with drying in between by using a household washing mashine requiring approx. 8.5 hours time. The course of knitted fabric shrinkage and the dependence of the same on the number of washing cycles is clearly seen in the FIG. 1 in Heap A. S., Greenwood P. F., Leah R. D., Eaton J. T., Stevens J. C., Keher P., "Prediction of Finished Weight and Shrinkage of Cotton Knits—The Starfish Project", Textile Res. J. 53, 2, 1983, 109–119 (2). The course of shrinkage will be explained further below, referring to FIG. 1.

The dependence of woven fabric shrinkage on the number of washing cycles is similar and is described by H. Asnes in "Massänderung nach wiederholtem Washen und Trocknen—Untersuchungen an Faser, Garn und Gewebe", 64, 1983, 217–220 (3). There will be quotations from this article below, the woven fabric shrinkage course being simultaneously documented by two figures.

The invention concerns a method and a device enabling a substantial reduction of the time necessary for relaxation and shrinkage of textile materials.

DEFINITION OF THE INVENTION

The invention is based upon the principle of rapid repeated washing, hot water treatment and drying of the textile material reference sample. The basis of the invention is, that one or more textile fabric reference samples are submitted separately to a short complete washing cycle, i.e. a washing, rinsing, hydroextraction and drying process, and to a few short treatment cycles in a whirling hot water bath, each treatment cycle being finished by a short hydroextraction and drying of the sample. The number of treatment cycles in a whirling hot water bath depends on the type of textile material, the area weight and textile structure of the same.

This process is performed with the incessant movement of the cross-over points and the flexing of the yarns in the textile structure of the sample, both during the complete washing cycle and the hot water treatment cycles. The movement of the cross-over points in the textile sample structure and the flexing of the yarns in the textile sample is being achieved by the whirling and may be enhanced by an oscillating movement of the sample, e.g. by a quick change of the textile sample movement direction, this being complemented by impacts of the same e.g. onto walls in the apparatus where it is treated. The textile sample oscillation frequency is preferably at least 1, preferably at least 2 and especially at least 3.5 cycles per second. The upper limit of the frequency should be 15, preferably 10, especially 8 cycles per second.

The sample may be made to oscillate in a perforated drum containing at least 2 radially arranged partitions dividing the drum into two or more chambers with an amplitude of about 360°/n, n being the number of partitions dividing the drum into chambers. Using this amplitude the sample will strike a partition each cycle. Owing to inertia it may be necessary to use a slightly higher frequency. However, when the sample strikes the partition during one cycle it will start to rebound towards the middle of the chamber and may, therefore, depending on the frequency not need as high an amplitude to strike another partition the next cycle. Thus, the necessary amplitude will depend on both the number of partitions and the frequency, usually lying between 360°: (n−2) and 360°: (n+2) when n is at least 3 and between 360°: (n−1) and 360°: (n+2) when n is 2.

The complete washing cycle and the individual hot water treatment cycles are being finished, after a short duration sample hydroextraction, by a short drying of the same in an air stream of maximum possible temperature, compatible with the textile sample material type, at simultaneous whirling of the textile sample in the air stream and with the incessant movement of the cross-over points in the textile sample structure and the flexing of the yarns in the textile sample.

The complete washing cycle with the sample drying and the hot water treatment cycles with the sample drying are being carried out immediately one following the other, whereby relaxation and effective shrinkage of the textile sample is being achieved.

The washing cycle comprises washing with a convenient detergent recommended for the textile material at maximum possible washing bath temperature compatible as far as heat is concerned, with the textile fabric type.

The washing cycle is followed by at least one single short term rinsing of the textile sample. Sample rinsing is being carried out in a new whirling water bath of maximum possible temperature, depending on the textile fabric type, in cooperation with the incessant movement of the cross-over points in the textile sample structure and with the flexing of the yarns in the textile sample.

Washing of the textile sample is continued until essentially all ingredients preventing sample shrinkage have been washed out, advantageously during 10 to 240 seconds.

Rinsing cycles should be carried out until the detergent has been removed from the textile sample. Every rinsing of the textile sample to be advantageously executed during 10 to 120 seconds.

Treatment cycles in the whirling hot water of the textile sample to be carried out advantageously during 5 to 120 seconds each.

Washing, rinsing and hot water treatment of the textile sample is preferably carried out at an oscillating movement of the same.

The textile sample is advantageously hydroextracted during 10 to 120 seconds, dried during 30 to 480 seconds, until it contains less moisture than the regain at standard atmosphere of 20° C., 65% RH.

The shrinkage of the textile sample is being checked by measuring its dimensions before and after the complete treatment.

The invented apparatus for performing the method of ascertaining relaxation and shrinkage behaviour of textile fabrics and textile products as well as their tendencies to spirality and twisting and changes in appearance, such as pilling, consists of a vertical perforated drum, rotable in two directions and arranged in a heat insulated protecting casing, covered by a heat insulated lid, and a means which can give the drum alternately a rotational motion or a suitable oscillating motion. Both a pressure air inlet from an air heater and a common water inlet with a prearranged water heater and water outlet, lead into the perforated drum. It is advantageous to arrange pumps between the water heater and the common water inlet and outlet. The perforated drum can be divided into several separate chambers. To enable visually checking the whirling of the textile samples, the heat insulated lid is made of transparent material or the same is equipped with at least one inspection hole.

The proposed method of carrying out the rapid shrinkage of textile is based on the further mentioned principles described below.

To minimize the time necessary for washing out all additives, as mechanical impurities, chemical additives, surplus dye-stuffs, finishing agents etc, the washing should be done by using a suitable, for the textile fabric material recommended, detergent at maximum possible water bath temperature, the latter to be compatible with the textile material type. The washing and hot water treatment should be done in a whirling bath with mechanical action on the textile material, i.e. with a quick frequency of subsequent beating cycles where the textile material hits the chamber walls of the perforated drum carrying out a rotating reversible motion. This mechanical beating process and the textile sample movement in the ever whirling bath enable the incessant movement of the cross-over points of the textile structure and flexing of the yarns and thereby the rapid removal washing out of all additives. Also by affecting each textile sample separately, maximum effect is being accomplished.

A further principle of the proposed method is the reduction, to a minimum, of the time necessary for drying the textile material. The drying of the same always takes place after hydroextraction. The drying pressure air is of maximum possible temperature according to the textile material type and during drying the textile sample is whirling in the air stream. Textile sample drying is being done also after every hot water treatment of the sample concluding the hydroextraction. It is recommended to carry out drying of the sample until it contains less moisture than its regain of standard atmosphere. Drying time is dependent on structure, area weight and type of material.

A further principle on which the invention is based is the maximum, but non-destructive mechanical processing of the textile sample in such manner as to achieve full release of the textile fabric cross-over points thus enabling the tensionless state of the textile fabric structure including the thread shrinkage. The mechanical textile fabric processing is taking place during washing, rinsing, hot water and drying treatments being realized by beating of the textile sample against the chamber walls of the drum. The hot water treatment cycles follow in quick sequence several times after one another. The total number of these cycles carried out without using a detergent depends on the utilized textile fabric type, the area weight of the textile sample, structure etc., but does usually not exceed five cycles. However, sometimes six or more cycles may be needed to obtain complete shrinkage.

DRAWINGS

The invention will be explained further with reference to the drawings on which

Figure 2:
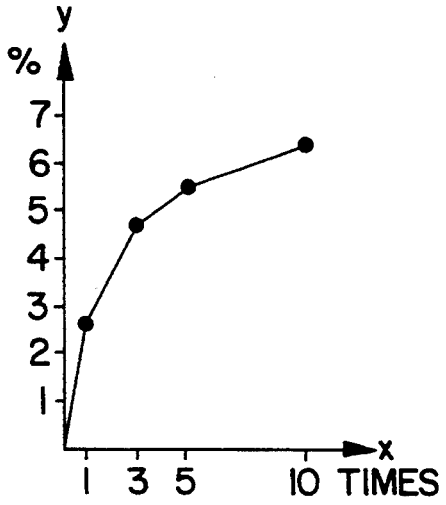
Figure 3:
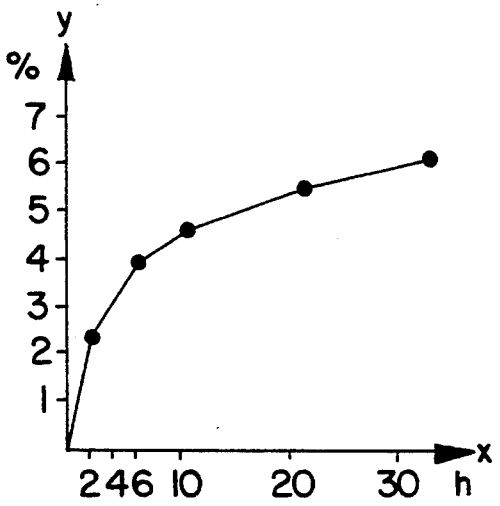
Figure 4:
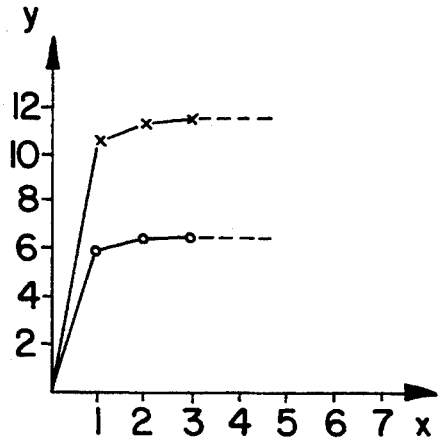
Figure 5:
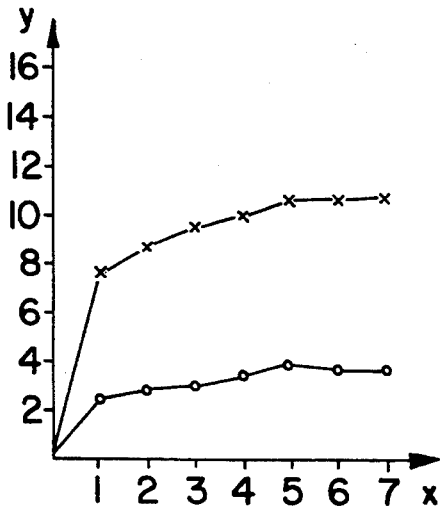
Figure 6:
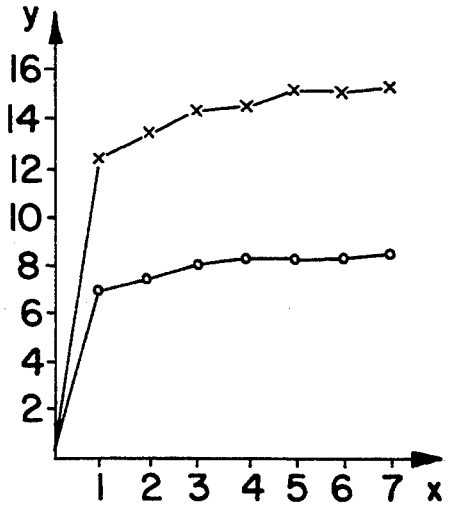

FIG. 1 shows the course of longitudinal shrinkage of twenty cotton knits of different structures and densities washed by classical method by means of a household washing machine, FIGS. 2 and 3 show the course of shrinkage in warp direction with cotton woven fabrics, also washed by means of a household washing machine, FIGS. 4, 5 and 6 show the course of textile fabrics shrinkage in width and length, the shrinkage of the same being carried out in accordance with the invention.

Figure 7:
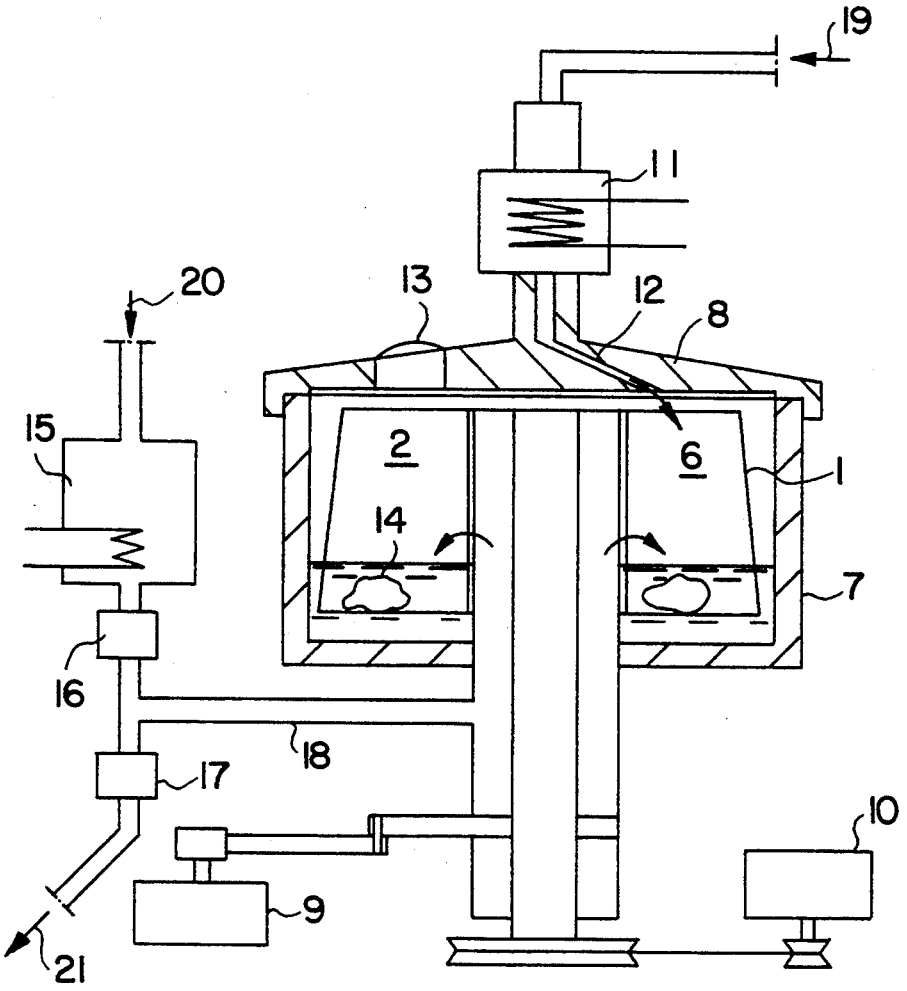
Figure 8:
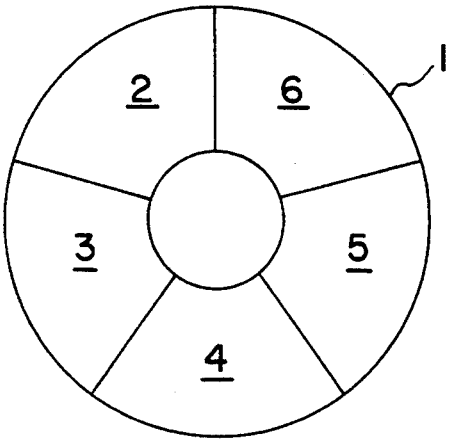

FIGS. 7 and 8 show a schematic view of an embodiment of the apparatus for realization of the rapid relaxation and shrinkage method for textile samples.

EXAMPLES

FIG. 1 shows the course of longitudinal shrinkage of twenty cotton knits of different structures and densities, washed in a household washing machine, according to the article (2). On the x-axis the number of washing cycles have been plotted, on the y-axis the part of total final shrinkage.

The longitudinal dimension change of a dyed cotton twill woven fabric after washing in a household washing machine at 90° C. is shown in FIG. 2 and FIG. 3 taken from literature marked (3).

On the x-axis in FIG. 2 the number of washing cycles have been plotted, on the y-axis the shrinkage in warp direction in per cents. In the diagram on FIG. 3 the time of washing and drying has been plotted in hours and on the y-axis the shrinkage in warp direction in per cents.

In FIG. 4 the shrinkage course for a lightweight cotton jersey with an area weight of 131 g/m$^2$ has been plotted, the same having been processed according to the invention. In FIG. 4 on the x-axis shows the number of operations where operation No. 1 represents one washing, two rinsings, hydroextracting and drying, operation No. 2 and 3 each representing a treatment in a whirling hot water bath followed by hydroextracting and drying and the y-axis shows the knitted fabric shrinkage in per cent. The lower curve marked by rings represents the fabric shrinkage in width and the upper curve marked by crosses represents the knitted fabric shrinkage in length (FIG. 4). By using the method of the invention a total shrinkage of this knitted fabric has been accomplished in the range of 11.5% in length and 6.5% in width after one complete washing cycle and two hot water treatment cycles, always with subsequent drying.

new water bath while the sample is mechanically affected by the drum chamber walls. After hydroextracting the sample for 30 seconds, drying of the same follows in the hot air stream during 180 seconds at zero movement of the chamber with the sample whirling. The complete washing cycle being finished by this operation.

Immediately after the complete washing cycle two identical complete hot water treatment cycles follow. The hot water treatment is carried out in a new hot water bath during 40 seconds while the drum is carrying out a reversing rotating motion. Each hot water treatment cycle is, after hydroextracting the previous sample during 30 seconds, finished by drying the textile sample under identical conditions as mentioned for the washing cycle.

Generally it is important to mention regarding the table that the individual times of the operation cycles differ for different textile fabric types and the optimization of the same is altogether very simple, for the quickest achieving of dimensionally stable samples.

TABLE

| | Complete washing cycle | | | | | | | | | | | 1:st complete hot water treatment | | | | | 2:nd complete hot water treatment | | | | |
|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 |
| Adding detergent | X | | | | | | | | | | | | | | | | | | | | |
| Adding hot water | 10 | | | 10 | | | 10 | | | | | 10 | | | | | 10 | | | | |
| Mechanical washing | | 80 | | | | | | | | | | | | | | | | | | | |
| Rinsing | | | | | 20 | | | 20 | | | | | | | | | | | | | |
| Hot water treatment | | | | | | | | | | | | | 40 | | | | | 40 | | | |
| Draining water bath | | | 10 | | | 10 | | | 10 | | | | | 10 | | | | | 10 | | |
| Hydroextracting of sample | | | | | | | | | | 30 | | | | | 30 | | | | | 30 | |
| Drying of sample in hot air stream | | | | | | | | | | | 180 | | | | | 180 | | | | | 180 |
| | 390 seconds | | | | | | | | | | | 270 seconds | | | | | 270 seconds | | | | |
| | Total 15.5 minutes | | | | | | | | | | | | | | | | | | | | |

The following table contains the diagram of the working procedure and the working schedule for the rapid relaxation and shrinkage of a lightweight jersey sample according to FIG. 4. Digits 1 to 21 mark the number of individual operations and in the left column of the table are given the names of the same operations. The time of the individual operations is in seconds. Operations 1 to 11 represent the complete washing cycle including rinsing, hydroextraction and drying lasting 390 seconds, operations 12 to 16 the first hot water treatement with hydroextraction and drying lasting 270 seconds and operations 17 to 21 the second hot water treatment with hydroextracting and drying lasting 270 seconds. The total time for achieving a dimensionally stable knitted fabric takes in the present case only 15.5 minutes. Compared to the traditional method of five complete washing cycles lasting in total 8.5 hours, a considerable time saving is obtained by the use of the method according to the invention.

According to the table, operation No. 2, the washing cycle, includes the textile sample washing during 80 seconds in whirling hot washing bath using a detergent as the sample is mechanically affected by the drum chamber walls. Filling the hot water according to operation No. 1 takes 10 seconds, emptying the washing bath according to the operation No. 3 also takes 10 seconds. Then follows a double sample rinsing in hot water without detergent during 20 seconds, always in a As an example of practically executed tests according to the present method with a heavier cotton knit of pique structure, area weight 227 g/m$^2$, the shrinkage curve is shown in FIG. 5. Here a longitudinal shrinkage of 11% and a crosswise shrinkage of 4% ocurred after one complete washing cycle and four complete hot water treatment cycles. On the x-axis in FIG. 5 the number of complete washing and complete hot water treatment cycles are shown, on the y-axis the sample shrinkages—in percent—have been plotted. The lower curve shows the textile fabric shrinkage course in width and the upper curve in length of the same.

The behaviour of a 270 g/m$^2$ (area weight) and 2/2 broken twill weave heavy cotton woven fabric (FIG. 6) is practically the same. After five operation cycles containing one washing with rinsing, hydroextracting and drying and four hot water treatment cycles with hydroextracting and drying a 15% lengthwise and 8.5% widthwise fabric shrinkage are obtained. On x-axis the number of operations, on y-axis sample shrinkage in percent have been plotted.

The equipment used for rapid relaxation and shrinkage of textile fabrics according to FIGS. 7 and 8 consists of a vertical drum 1, divided e.g. into five separate chambers 2, 3, 4, 5, 6, where the textile fabric samples 14 are placed, one in each chamber. The perforated drum 1 is arranged in a heat insulated protecting casing 7, covered by a heat insulated lid 8. The perforated drum 1 can execute both a rotating motion and a rotating-oscillating motion, i.e. a clockwise motion within a selected short time interval followed by a motion reverse to the clockwise one. This rotating, intermittently in the opposite direction executed motion of the perforated drum 1, has to be carried out at such a frequency as to bring about, with certainty, in every cycle the impact of each sample 14 against one of the partitions or a cylindrical wall in the independent chamber 2, 3, 4, 5, 6 in question during the washing, rinsing and hot water treatment cycles. The rotating reversing motion of the perforated drum 1 is achieved by the motor 9, the rotating motion of the perforated drum 1 at hydroextraction of the textile sample 14 has been derived from the motor 10.

The embodiment of the apparatus used to carry out the process shown in FIG. 4 and in the table comprised a drum with a height of 135 mm, an inner diameter of 70 mm, an outer diameter of 270 mm and divided into five chambers 2–6 by five partitions. The drum was given an oscillating rotating motion of a frequency of 220 oscillations or cycles per minute (3.7 cycles/sec) and an amplitude of 72°.

The equipment has been further provided with an efficient air heater 11, into which the pressurized air is being fed in the direction of the arrow 19. From the air heater 11 hot air is being distributed by inlets 12 into the individual chambers 2, 3, 4, 5, 6 of the perforated drum 1. The openings of the inlets 12 are arranged in the upper part of the casing 7 above the edge of the vertical drum 1. When the drum stands still one inlet opening will be above each chamber to enable blowing hot air into the chamber to achieve a whirling and drying of the sample in the chamber.

The lid 8 has been provided with inspection holes 13 for checking the movement of the textile fabric sample 14. In an alternative embodyment the heat insulated lid 8 can be made of transparent material.

Further the equipment comprises a water heater 15 into which water enters in the direction of arrow 20 and hot water is being forced by pump 16 through common water inlet and outlet 18 into the protecting casing 7 and thereby into the independent chambers 2, 3, 4, 5, 6, of the perforated drum 1, too. Water outlet from the perforated drum 1 is being mediated by pump 17 through the common water inlet and outlet 18 in the direction of arrow 21.

Into each of the independent chambers 2, 3, 4, 5, 6 of the perforated drum 1 with the lid 8 lifted one textile fabric sample 14, e.g. of 20×20 cm dimension, is being placed, each sample 14 with previously marked points for checking the shrinkage of the same. A previously determined quantity of a suitable detergent is being added. The cover 8 is to be closed impermeably and a certain quantity of hot water from the water heater 15 by means of pump 16 is being fed. Motor 9 is started, by means of which the perforated drum 1 gets into rotating oscillating motion and the washing cycle of sample 14 is taking place with intense whirling of the washing bath and with repeated impacts of samples 14 into the walls of the independent chambers 2, 3, 4, 5, 6.

After a set time bath pumping off by pump 17 occurs and letting in of clean hot water from the water heater 15 by pump 16. At the following rotating oscillating motion of the perforated drum 1, rinsing of samples 14 is being carried out. After the set time the water is pumped off by pump 17 and eventually the samples 14 are being rinsed again in a new water bath. By starting the motor 10, hydroextracting of all samples 14 is performed. The drying of textile samples 14 follows by feeding hot pressure air from the air heater 11 by means of inlets 12 into the perforated drum 1. The inlets 12 are pointed in such way, as to ensure the whirling movement of samples 14 in the individual chambers 2, 3, 4, 5, 6 of the perforated drum 1. In this way the unfolding of samples 14 is being ensured with an intensive drying of the same and, at the same time, an incessant movement of the yarns at cross-over points in the textile fabric structure, whereby the relaxation and shrinkage of the same is effectively taking place.

After drying the samples 14 the treatment of the same in whirling hot water bath is taking place under analogous conditions as rinsing, whereas this water treatment is being finished by emptying the water bath, hydroextracting and drying the samples 14 under the above mentioned conditions. The hot water treatment and drying process is being repeated until sufficiently stable dimensions of samples 14 have been achieved.

The amount of sample shrinkage and the shrinkage curve of the same are being obtained by remeasuring sample dimensions after having carried out the working cycle.

The equipment is being controlled from the control desk and the parameters of individual procedure operations are adjustable and may be controlled by a processor.

Industrial applicability

The method of the invention and the equipment for rapid relaxation and shrinkage of textiles make it possible—within incomparably shorter time than with contemporary methods—to determine

- the shrinkage potential of the textile fabric and the reference state of the same,
- the course of relaxation and shrinkage of textiles and its dependence of the numbers and temperature conditions of washing and drying treatment
- the tendencies to spirality and twisting of the textile fabric
- and at the same time the expected behaviour of the textile fabric in wear and maintenance.

This rapid determination of the shrinkage potential of textile fabrics is an entirely new testing method for operation control and determination of suitable parameters for the finishing of textile fabrics, e.g. determination of the necessary preshrinkage on a drying and tenter frame, further for checking the shrinkage potential of woven and knitted fabrics before making-up etc.

Further the method according to the invention is a precision analytical method for the research of relaxation and shrinkage behaviour of textiles.

I claim:

1. A method of ascertaining relaxation and shrinkage behaviour of textile fabrics and textile products as well as their tendencies to spirality, twisting and changes in appearance, such as pilling, comprising repeated washing and drying of a sample of the textile product, characterized in that the sample is separately submitted to a short washing cycle during at most 240 seconds in a hot washing bath containing a detergent, followed by a few short rinsing cycles during at most 120 seconds in a hot water bath, followed by a short hydroextraction of the sample during at most 120 seconds and drying in an air stream of maximum temperature compatible with the sample textile type, followed by a few treatment cycles in a hot water bath during at most 120 seconds, each treatment being finished by a short hydroextraction of the sample and drying in the same way as after the rinsing, the sample being made to oscillate with a frequency of at least 1 cycle per second during all washing, rinsing and hot water treatment and to whirl during air stream drying, thereby incessantly moving the yarns at crossover points and flexing the yarns in the textile structure of the sample.

2. A method of claim 1, characterized in that the washing cycle is performed in a bath containing a detergent or a wetting agent at maximum possible temperature compatible with the textile type of the sample.

3. The method of claim 1, characterized in that the washing cycle is performed until all additives have been washed from the sample.

4. The method of claim 1, characterized in that the time of the washing cycle is 10–240 seconds.

5. The method of claim 1, characterized in that the rinsing cycles are repeated until practically all detergent and wetting agent have been removed from the sample.

6. The method of claim 1, characterized in that each rinsing cycle is performed for a time period of 10–120 seconds.

7. The method of claim 1, characterized in that each hydroextraction of the sample is carried out for a time period of 10–120 seconds.

8. The method of claim 1, characterized in that the time of drying the sample is 30–480 seconds each time.

9. The method of claim 1, characterized in that the sample is dried until it contains less moisture than the regain of the sample at standard atmosphere of 20° C., 65% RH.

10. The method of claim 9, characterized in that the sample is dried until it contains less moisture than half of the regain of the sample at standard atmosphere of 20° C., 65% RH.

11. The method of claim 1, characterized in that each hot water treatment cycle is carried out for a time period of 5–120 seconds.

12. The method of claim 1, characterized in that the shrinkage of the sample is determined by measuring the dimensions of the sample before the washing cycle and after the last treatment cycle.

13. The method of claim 1, characterized in that the sample is made to oscillate with a frequency of at least 2, especially at least 3.5, cycles per second.

14. The method of claim 13, characterized in that the sample is made to oscillate with a frequency of at most 15, preferably at most 10, especially at most 8, cycles per second.

15. The method of claim 1, characterized in that the sample is made to oscillate in a perforated drum (1) containing at least 2 radially arranged partitions dividing the drum into two or more chambers (2–6) with an amplitude of about 360°/n, n being the number of partitions dividing the drum into chambers.

16. An apparatus for ascertaining relaxation and shrinkage behaviour of textile fabrics and textile products as well as their tendencies to spirality, twisting and changes in appearance, which comprises a vertical perforated drum (1), rotatable in two directions and arranged in a heat insulated protecting casing (7), covered by a lid (8), a means which can give the drum alternately a rotational motion or an oscillating motion, an air heater (11), and a water heater (15) connected to the casing via a water inlet and outlet pipe (18), the drum containing at least 2 radially arranged partitions dividing the drum into two or more chambers (2–6), the air heater (11) being connected to the inside the casing (7) over inlets (12), one for each chamber and ending above the drum.

17. An apparatus according to claim 16, characterized in that pumps (16, 17) are arranged between the water heater (15) and the water inlet and outlet pipe (18).

18. An apparatus according to claim 16, characterized in that the perforated drum is divided by partitions into 4–10, preferably 5–7, independent chambers (2–6).

19. An apparatus according to claim 16, characterized in that the lid (8) is equipped with an inspection window (13) of transparent material.

* * * * *